US008167264B2

(12) United States Patent
Hansen et al.

(10) Patent No.: US 8,167,264 B2
(45) Date of Patent: May 1, 2012

(54) SELF-SUPPORTING INTERIOR WALL FOR USE IN CONCRETE CASTING EQUIPMENT USED IN CONCRETE CASTING MACHINES

(75) Inventors: Erik Spangenberg Hansen, Østbirk (DK); Jesper Bjørn Rasmussen, Brabrand (DK)

(73) Assignee: KVM Industrimaskiner A/S, Kjellerup (DK)

( * ) Notice: Subject to any disclaimer, the term of this patent is extended or adjusted under 35 U.S.C. 154(b) by 644 days.

(21) Appl. No.: 11/921,340

(22) PCT Filed: May 26, 2006

(86) PCT No.: PCT/DK2006/000289

§ 371 (c)(1),
(2), (4) Date: Nov. 30, 2007

(87) PCT Pub. No.: WO2006/128458

PCT Pub. Date: Dec. 7, 2006

(65) Prior Publication Data

US 2009/0127428 A1 May 21, 2009

(30) Foreign Application Priority Data

Jun. 1, 2005 (DK) ..... 2005 00800

(51) Int. Cl.
*B28B 7/24* (2006.01)

(52) U.S. Cl. ..... 249/131; 249/120; 249/132; 249/139; 249/160; 249/168; 425/253; 425/344; 425/412; 425/453; 425/470

(58) Field of Classification Search ..... 425/110, 425/183, 185, 193, 195, 255, 260, 344, 346, 425/353, 359, 351, 412, 413, 416, 422, 436 R, 425/444, 452, 454, 470, 468, 253, 453; 249/35, 249/47, 52, 69, 71, 72, 76, 98, 102, 112, 249/115, 119, 129, 125, 130, 139, 163, 166, 249/124, 148, 160, 168, 189, 192, 120, 131, 249/132

See application file for complete search history.

(56) References Cited

U.S. PATENT DOCUMENTS 1,326,902 A 1/1920 Atterbury (Continued)

FOREIGN PATENT DOCUMENTS

DE 2555714 6/1977

(Continued)

*Primary Examiner* — Joseph Del Sole
*Assistant Examiner* — Seyed Masoud Malekzadeh
(74) *Attorney, Agent, or Firm* — James Creighton Wray

(57) ABSTRACT

Self-supporting intermediate walls (12) for cellular division of mould lower parts in a concrete casting machine of the kind typically used for making cast items in the form of concrete blocks for wall construction and elements, solid blocks or blocks with cavities or recesses in two or more rows. By the self-supporting design, the distance between rows of products may be reduced for better utilization of the production plate while at the same time maintaining the replaceability of wear parts. By the invention is indicated a self-supporting intermediate wall (12) consisting of two halves, an intermediate wall with lower pins (18) and an intermediate wall with upper pins (20) which, when the two halves are assembled with the pins engaging a partitioning plate (8), form a self-supporting intermediate wall (12). For moulds with core supports (28), intermediate wall parts (22 and 23) are used with a recess (25) in which the boss (29) on the core support iron (28) fits.

16 Claims, 8 Drawing Sheets

U.S. PATENT DOCUMENTS 1,385,186 A * 7/1921 Muth ..... 249/123
1,458,551 A 6/1923 Seat
1,471,951 A 10/1923 Evans
1,526,667 A * 2/1925 Flam ..... 249/123
1,642,247 A * 9/1927 Krause ..... 249/102
2,048,412 A * 7/1936 Sissman ..... 249/130
2,081,078 A * 5/1937 Watson ..... 126/373.1
2,232,632 A * 2/1941 Reynolds ..... 229/120.1
2,307,606 A * 1/1943 Steenstrup ..... 249/131
2,340,674 A * 2/1944 Mallard ..... 249/203
2,348,956 A * 5/1944 Carney ..... 249/203
2,370,925 A * 3/1945 Wade ..... 249/52
2,440,582 A * 4/1948 Green ..... 249/99
2,459,940 A * 1/1949 Himmel ..... 220/529
2,522,603 A * 9/1950 Case ..... 249/175
2,550,977 A * 5/1951 Dimock ..... 249/93
2,849,869 A * 9/1958 Baillif et al. ..... 249/70
2,934,916 A * 5/1960 Erickson et al. ..... 62/344
2,983,983 A * 5/1961 Mayer ..... 249/129
3,021,694 A * 2/1962 Bauerlein ..... 62/349
3,163,911 A * 1/1965 Kenney ..... 249/41
3,171,185 A * 3/1965 Anderson ..... 249/34
3,327,986 A * 6/1967 Oury ..... 249/45
3,664,630 A * 5/1972 Maynen et al. ..... 49/112
3,802,659 A * 4/1974 Lebherz ..... 249/52
3,844,526 A * 10/1974 McCracken ..... 249/152
3,940,229 A * 2/1976 Hutton ..... 425/436 R
4,033,545 A * 7/1977 Duwe et al. ..... 249/98
4,050,865 A * 9/1977 Drostholm et al. ..... 425/183
4,181,286 A * 1/1980 Van Doren ..... 249/82
4,218,206 A * 8/1980 Mullins ..... 425/253
4,261,693 A * 4/1981 Rayner et al. ..... 425/431
4,525,133 A * 6/1985 Bergmann ..... 425/120
4,776,481 A * 10/1988 Kidd ..... 220/532
5,017,049 A * 5/1991 Sievert ..... 405/284
5,020,769 A * 6/1991 Botes ..... 249/44
5,062,610 A * 11/1991 Woolford et al. ..... 249/52
5,198,127 A * 3/1993 Tilley et al. ..... 249/92
5,297,772 A * 3/1994 Stefanick ..... 249/102
5,372,349 A * 12/1994 Elmore ..... 249/112
5,445,514 A * 8/1995 Heitz ..... 425/255
5,542,837 A * 8/1996 Johnston ..... 425/183
5,589,124 A * 12/1996 Woolford et al. ..... 264/157
5,904,798 A * 5/1999 Bradford et al. ..... 156/309.6
5,939,104 A * 8/1999 Johnston ..... 425/356
6,007,321 A * 12/1999 Meckel et al. ..... 425/432
6,142,713 A * 11/2000 Woolford et al. ..... 405/286
6,183,168 B1 * 2/2001 Woolford et al. ..... 405/286
6,312,197 B1 * 11/2001 Woolford et al. ..... 405/286
6,428,726 B1 * 8/2002 Pribyl ..... 264/71
6,817,857 B2 * 11/2004 Spangenberg et al. ..... 425/254
6,892,498 B1 * 5/2005 Roman ..... 52/79.5
6,938,382 B2 * 9/2005 Schmitz ..... 52/89
7,291,306 B2 * 11/2007 Ishler ..... 264/334
7,309,226 B2 * 12/2007 Hansen et al. ..... 425/255
7,497,677 B1 * 3/2009 Crian et al. ..... 425/185
7,500,843 B2 * 3/2009 Crain et al. ..... 425/185
7,575,217 B2 * 8/2009 Jucha et al. ..... 249/130
7,575,700 B2 * 8/2009 Ishler ..... 264/71
2002/0025357 A1 * 2/2002 Spangenberg et al. ..... 425/346
2004/0245429 A1 * 12/2004 Rasmussen et al. ..... 249/119
2006/0134254 A1 * 6/2006 Hansen et al. ..... 425/255
2006/0272259 A1 * 12/2006 Ryder ..... 52/562
2009/0038488 A1 * 2/2009 Hansen et al. ..... 100/218

FOREIGN PATENT DOCUMENTS

EP 0562209 9/1993
WO WO 2004/071732 8/2004

* cited by examiner

SELF-SUPPORTING INTERIOR WALL FOR USE IN CONCRETE CASTING EQUIPMENT USED IN CONCRETE CASTING MACHINES

This application claims the benefit of Danish Application No. PA 2005 00800 filed Jun. 1, 2005 and PCT/DK2006/000289 filed May 26, 2006, which are hereby incorporated by reference in their entirety.

The present invention concerns casting equipment with self-supporting intermediate walls for concrete casting machines of the kind typically used for making cast items in the form of concrete blocks for wall construction and elements, solid blocks or blocks with cavities or recesses. The casting equipment includes a cellular lower part with upwards and downwards open cells that define the desired basic shape of the individual blocks and elements. The cells are divided with self-supporting bolted intermediate walls, and a corresponding upper part with an upper retainer plate that includes pressing pistons projecting downwards, the pressing pistons designed with lower thrust plates which fit in the respective underlying cells in the lower part and thereby are useful for downwards retention in the compression stage, and ejection of the cast items from the cells, and where, if concrete blocks with cavities or recesses are produced, the lower part includes means ensuring that the core elements forming cavities maintain their position in the lower part.

In connection with casting concrete blocks on large machines, often two or more rows of concrete blocks are cast on each production plate. If the concrete blocks are with cavities, e.g. foundation blocks, perforated blocks and elements with cavities, there is used a casting equipment including a lower part with casting cells with hanging cores, corresponding to the desired shape of the cavity/recess in the concrete block. An upper part with pressing plates corresponding to the shape of the casting cells is used as multiple press piston during the compression so that the pressing plates at the stripping of the items by vertical displacement of the lower part are passed down through the casting cells.

From U.S. Pat. No. 1,471,951 is known a lower part of a mould for use in concrete casting equipment which mould includes a number of intermediate walls and partitionings, where one or more intermediate walls together with one or more partitionings are made as a self-supporting construction.

In order to utilise the mould area/production plate as optimally as possible, it is necessary to have as little spacing as possible between the cast rows. By enabling making the mould with a thinner intermediate wall, the production plate can be shorter, or the products be longer on a given production plate. The wasted space in the hardening chambers may thereby be reduced, or alternatively space can be provided for more production plates. In some cases, it may also be a question whether the product can be produced profitably on a given production plate at all, e.g. where the length of the product combined with the intermediate wall will entail that two or three rows of products just cannot be produced on the production plate. In these cases, the mould have often been made as fixed, welded moulds without replaceable wear parts, implying that the mould has to be discarded due to wear when one cell only exceeds the tolerances applied to the product in question.

Another advantage of the new construction is that a mould frame designed for the new construction may be used for other lengths of products by only making another type of partitioning and adding/removing intermediate walls, or that a mould frame can be equipped with partitionings and intermediate walls in order to produce differently sized products in the same mould. Another possibility is that the mould frame can be used for another width of the product by replacing end walls and add/remove partitionings, however, this option requires the presence of more holes in the mould frame at the front and rear.

The traditional configuration with double-row moulds has been that the mould frame is welded with a middle wall, whereby two mould frame spaces appear. In these mould frame spaces, the replaceable insert parts are fitted to form the shape of the cells and thereby the real shape of the product. These wear parts typically consist of a number of partitionings, which divide the mould frame spaces crosswise, and a gable plate at each side. The gable plates and the partitionings have been kept with the desired spacing corresponding to the desired block width with end plates. In order to secure the partitionings, end plates, partitionings and gable plates are all designed with mutually disposed cutouts. When partitioning plates, gable plates and end plates for filling out a mould frame space are in position, the insert parts are compressed in the mould space by means of bolts through the sides of the mould frame space. The end plates are bolted to the mould frame and thereby secure the intermediate wall dividing the mould frame space. Finally, the gable plates are fastened with bolts in the mould frame after intermediate layers have been placed behind the gable plates for filling the cavity appearing in order for the insert part to be fitted.

The drawback of the fixed, welded mould frame is that the intermediate wall and thereby the spacing between two or more rows of concrete blocks becomes disproportionately large, so that the production plate is not utilised optimally, or that the mould plate is to be greater to compensate for the greater wall thickness. The more rows of cast products, the less utilisation of the production plate, and thereby the hardening area where the production plates with products are disposed for hardening.

Alternatively, the entire lower mould part with cells is welded, where the cell walls are hardened (and thereby integrated) before welding together. In. order to enable welding together the hardened parts, prior to hardening the parts have to be covered on the faces where they are to be welded together later. This covering typically is effected with a coat of poisonous paint.

By this method of making, the entire insert has to be discarded as soon as one cell exceeds the tolerance of the product because of the unavoidable wear.

The method of making furthermore has the unfavourable property that it is difficult to achieve sufficiently fine/small tolerances due to the material shrinking caused by the weldings. It is very difficult to make the mould so that the cells in the mould have the same size, implying that due to wear, a cell which as new is within the tolerance very quickly will exceed the maximum dimension for the products a long time before a cell with a tolerance close to the minimum dimension.

In other cases, insert parts and wear parts are made of steel with great wearability. These parts are welded into the mould frame in order to form the cell apertures. Here, the durability has not shown to be satisfactory either. The method of making has also the unfavourable property that it is difficult to achieve sufficient small/fine tolerances, as it is very difficult to make the mould so that the cells in the mould have the same size due to material shrinking caused by weldings. This means that due to wear, a cell which as new is within the tolerance very quickly will exceed the maximum dimension for the products a long time before a cell with a tolerance close to the minimum dimension.

By the invention is indicated a lower part which includes a new self-supporting intermediate wall construction which by the special design of the intermediate walls entails that the intermediate walls go in and lock the intermediate walls with the partitionings. Together with the partitionings and the intermediate walls, the end walls constitute the entire insert. The insert parts are fastened releasably, preferably by bolt connections, to the mould frame.

By making the insert parts as single parts and subsequently hardening these single parts, it is much easier to control the tolerances on these single parts, whereby the single cells in the mould largely have the same size after assembling. Inaccuracies arising in connection with welding, e.g. material shrinkage, are thus eliminated.

The bearing partitioning is through-going from one end wall in the mould frame to the other end wall. The wear part on the end walls have two shapes, the end wall of one wear part having upper locking pins with largely the same width as the thickness of the partitionings, the end wall of the other wear part having lower locking pins with largely the same width as the thickness of the partitionings. Furthermore, the end wall of the second wear part also has a collar at the bottom projecting to support the end wall of wear part up under the mould frame. Hereby is ensured that the end wall, and thereby the entire insert, cannot slide upwards during the strong compressing vibration of the casting equipment.

The intermediate wall is constituted by two plates, one plate designed with upper pins extending largely halfway through the through-going bearing partitioning, the other plate designed with lower pins extending largely halfway through the through-going partitioning. When these two intermediate walls are mounted so that the plate with the upper pins is mounted from above, fitting into recesses at the top of the partitioning, and the plate with lower pins from below, fitting into recesses at the bottom of the partitioning, the intermediate wall can move neither up nor down.

The recesses in the partitionings are displaced in relation to the centre of the partitioning, so that when the two intermediate wall plates are mounted, they only form the intermediate wall, and when they are clamped together with bolts, they lock onto the partitionings. The intermediate plates of the outermost cells are further locking to the gable plates.

The reason for the pins only extending almost half through the partitionings is that on the other side of the partitioning there may also be mounted two intermediate wall plates with upper and lower pins, respectively. Due to the tolerances in the making process it is hereby ensured that all intermediate wall plates come into full contact with the partitionings at both sides. The partitioning plates are fixed/secured in the mould frame by the two types of end wall plates, alternately with an end wall plate with lower pins and an end wall plate with upper pins. The pins on the end wall plates have almost the same size as the thickness of the partitioning plates, thereby ensuring that the partitionings are secured and fixed in the mould frame when the screw bolts through the sides of the mould frame press the gable plates together around the other insert parts.

The advantage of the design is furthermore that if a partitioning, an end wall, an intermediate wall or a gable for some reason is damaged or worn quicker than the others, they may be replaced individually without having to disassemble the entire insert.

Another advantage of the invention is that if the concrete articles have cavities, the constituent core elements may be designed so that they are secured in their position in the mould by recesses in the self-supporting intermediate wall.

The invention is then described briefly with reference to the drawing, on which:

DETAILED DESCRIPTION OF THE PREFERRED EMBODIMENTS

Figure 1:
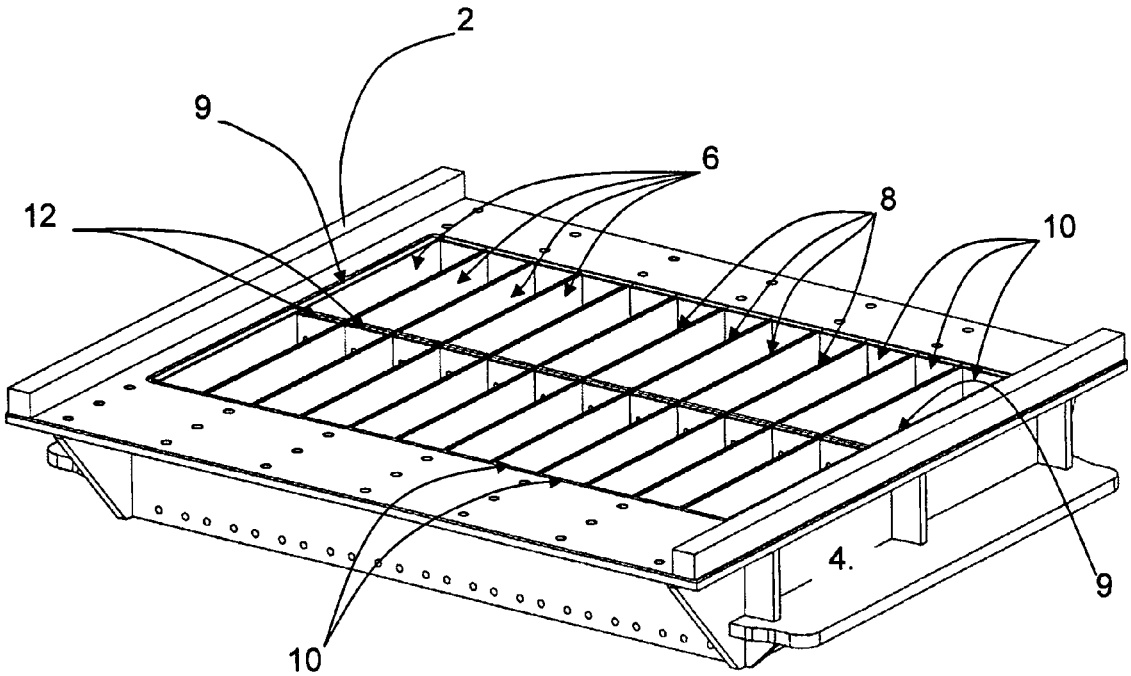
FIG. 1 is a perspective view of a lower mould part according to the invention.

FIG. 1 shows a lower mould part (2) consisting of a mould frame (4) with the new self-supporting intermediate walls (12). After welding and annealing, the mould frame space for the insert parts is machined to dimensions, e.g. by milling, so that all faces on which insert parts are to be mounted, are plane and machined within the desired tolerances. After this machining, firstly a gable (9) is mounted, then end walls (10), alternately end walls with lower pins (14) and end walls with upper pins (16), and after each mounting of end plates (14, 16) a partitioning (8) is placed, ending with a gable plate (9) before the intermediate walls (12), with intermediate wall with lower pins (18) mounted from below and intermediate wall with upper pins (20) mounted from above. The intermediate walls are mounted in each longitudinal cell which is hereby divided into two cells forming the desired product shape. When all insert parts are loosely mounted in the mould frame, the yet loose insert parts with bolts through the side of the mould frame (not shown) are compressed, simultaneously ensuring that all parts are correctly disposed in relation to each other. When this is done, the insert parts are clamped to the mould frame, and the intermediate wall plates (18 and 20) are clamped together so that they interlock with the partitionings. Finally, the gable plates (9) are bolted to the side of the mould frame (4) after laying intermediate layers behind the gables for filling out the cavity remaining in the mould frame space. The remaining cavity appears in the mould frame space because the mould frame space itself is made identical for various product widths.

Figure 2:
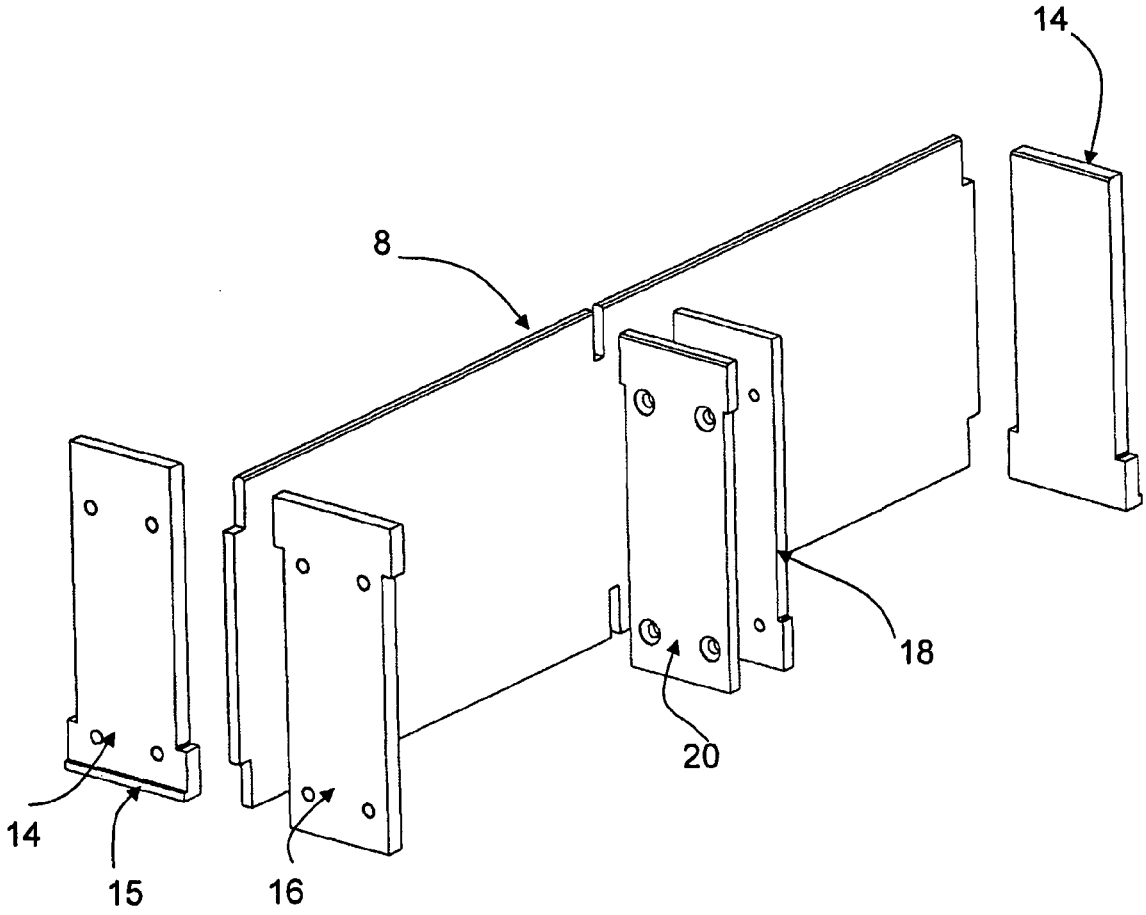
FIG. 2 is an exploded perspective view of the assembling principle of the wear parts of the cell division, of the intermediate wall, according to the invention.
Figure 3:
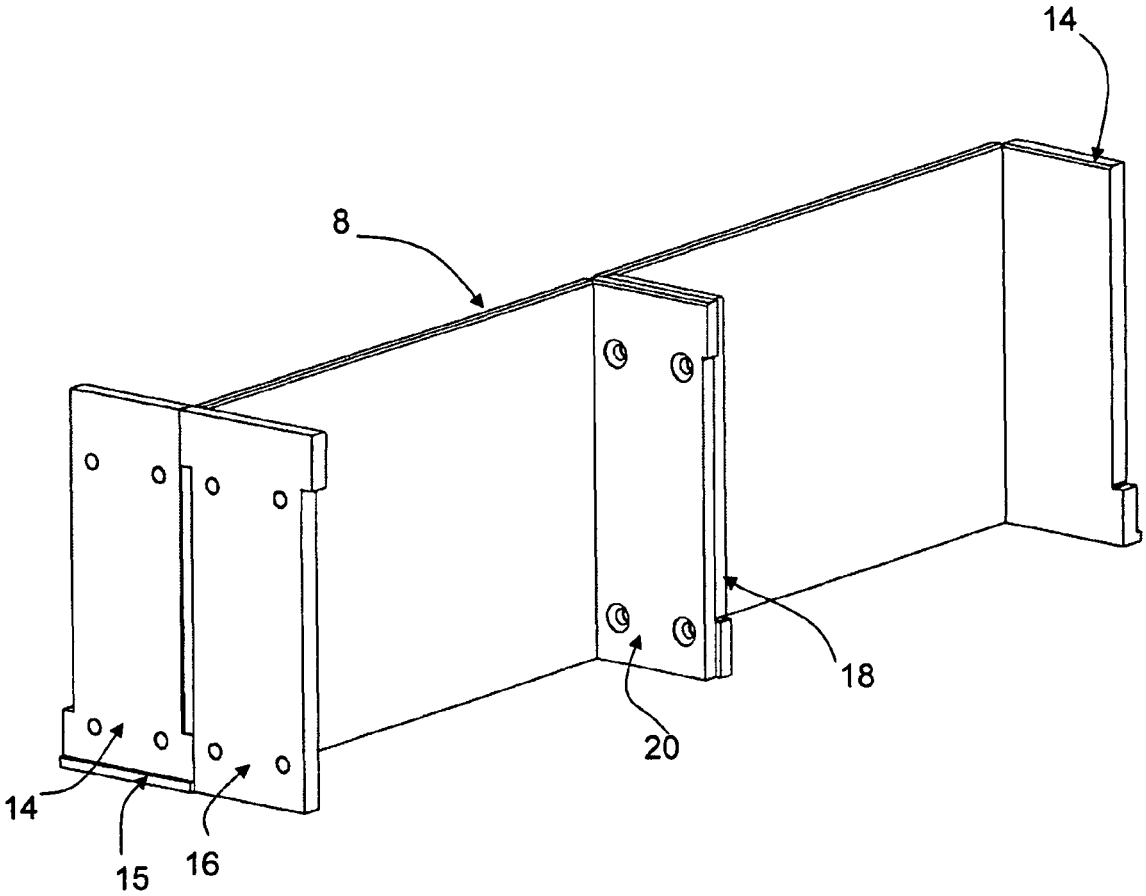
FIG. 3 is a perspective view of the assembling principle of the wear parts of the cell division, of the intermediate wall, according to the invention, where the parts from FIG. 2 are assembled.

FIGS. 2 and 3 show an exploded and an assembled self-supporting intermediate wall (12), respectively, where intermediate walls with lower pins (18) and intermediate wall with upper pins (20) are shown opposite to partitioning (8). When the two intermediate walls are disposed back to back and the pins are fitted into the partitioning and the bolts (not shown)

are mounted in respective holes, where there are free holes for a countersunk screw in one intermediate wall part, here shown in the intermediate wall part with upper pins (20), and there are threaded holes in the opposing intermediate wall part, here shown in the intermediate wall part with lower pins (18), the intermediate wall parts are interlocked, and they will subsequently not be able to move up or down. They can not move laterally either, as they are enclosed between two partitionings (8). Furthermore, it appears how the end walls (14, 16) fit into the partitionings with pins, end wall with lower pins (14) and collar (15) and end wall with upper pin (16) locking and ensuring that the partitioning plate (8) can move neither up nor down as soon as the end walls (14, 16) are fastened with bolts to the mould frame. The collar (15) on end wall with lower pins (14) ensures that when the end wall is mounted, the collar (15) goes out and supports under the bottom of the mould frame (not shown), thereby ensuring that the insert parts cannot slide upwards when the insert parts are clamped to the mould frame.

Figure 4:
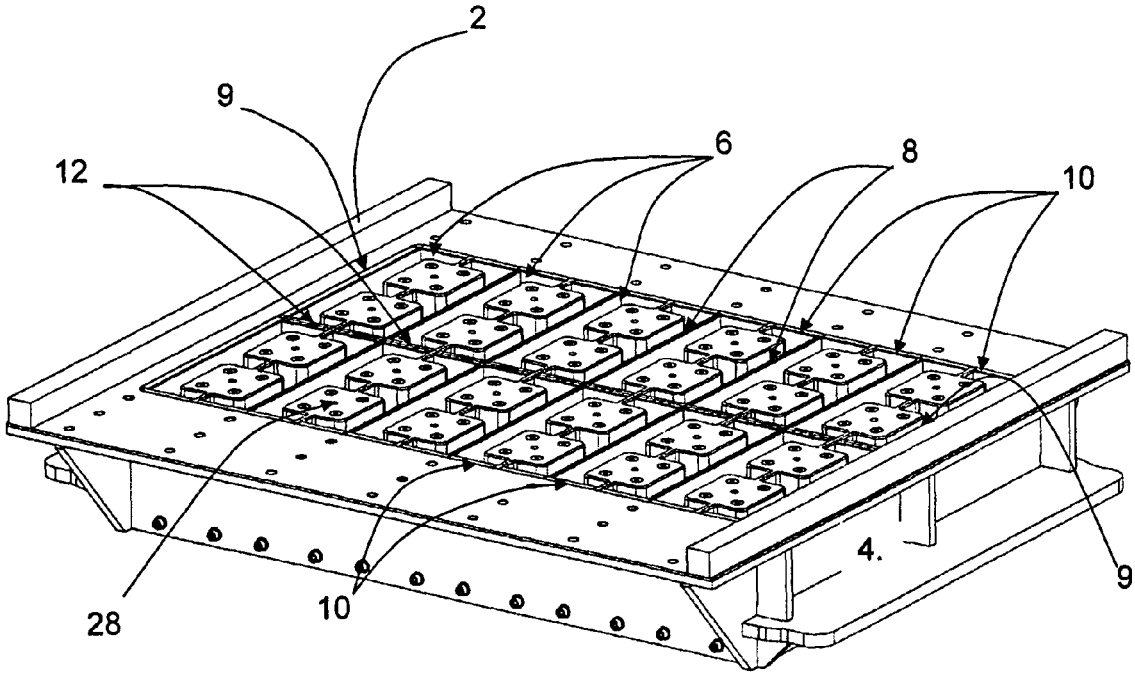
FIG. 4 is a perspective view of a casting equipment according to the invention with core elements.

FIG. 4 shows a mould lower part (2) consisting of a mould frame (4) with core iron supports (28) disposed in each of the cells (8) according to the invention, with self-supporting intermediate walls (12) with recesses (25) for supporting and bearing the core irons (28). The core irons serve as holders for the cores forming the cavities in the finished product. The mould frame space for the insert parts is made as mentioned under FIG. 1. The core iron supports (28) have pins (29) at the centre of the core irons (29) which fit into a corresponding recess (25) in the two intermediate wall parts (24, 26), as shown on FIG. 5.

Figure 5:
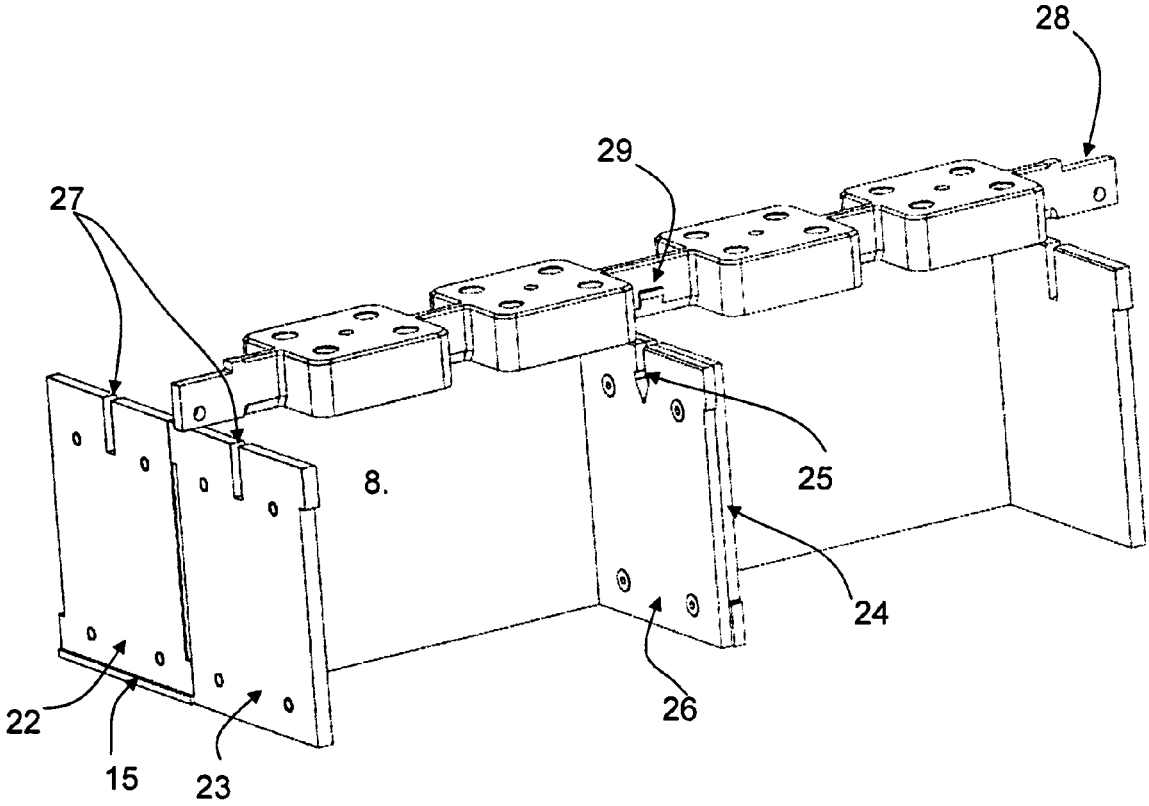
FIG. 5 is an exploded view of the assembling principle of the wear parts of the cell division, of the intermediate wall, according to the invention, where it appears how the core iron support is supported in the intermediate wall.

FIG. 5 shows an assembled self-supporting intermediate wall where the core iron (28) has been pulled out so that it may be seen how the boss (29) is disposed on the core iron (28), and that it fits into corresponding recesses (25) in each of the two intermediate walls, where intermediate wall with lower pins (24) and intermediate wall with upper pins (26) are shown opposite to partitioning (8). At the same time, the end walls with lower pins (22) and upper pins (23) are also with recess (27) for core iron (28) so that the core iron may extend out into mould frame (4) where they are fastened.

Figure 6:
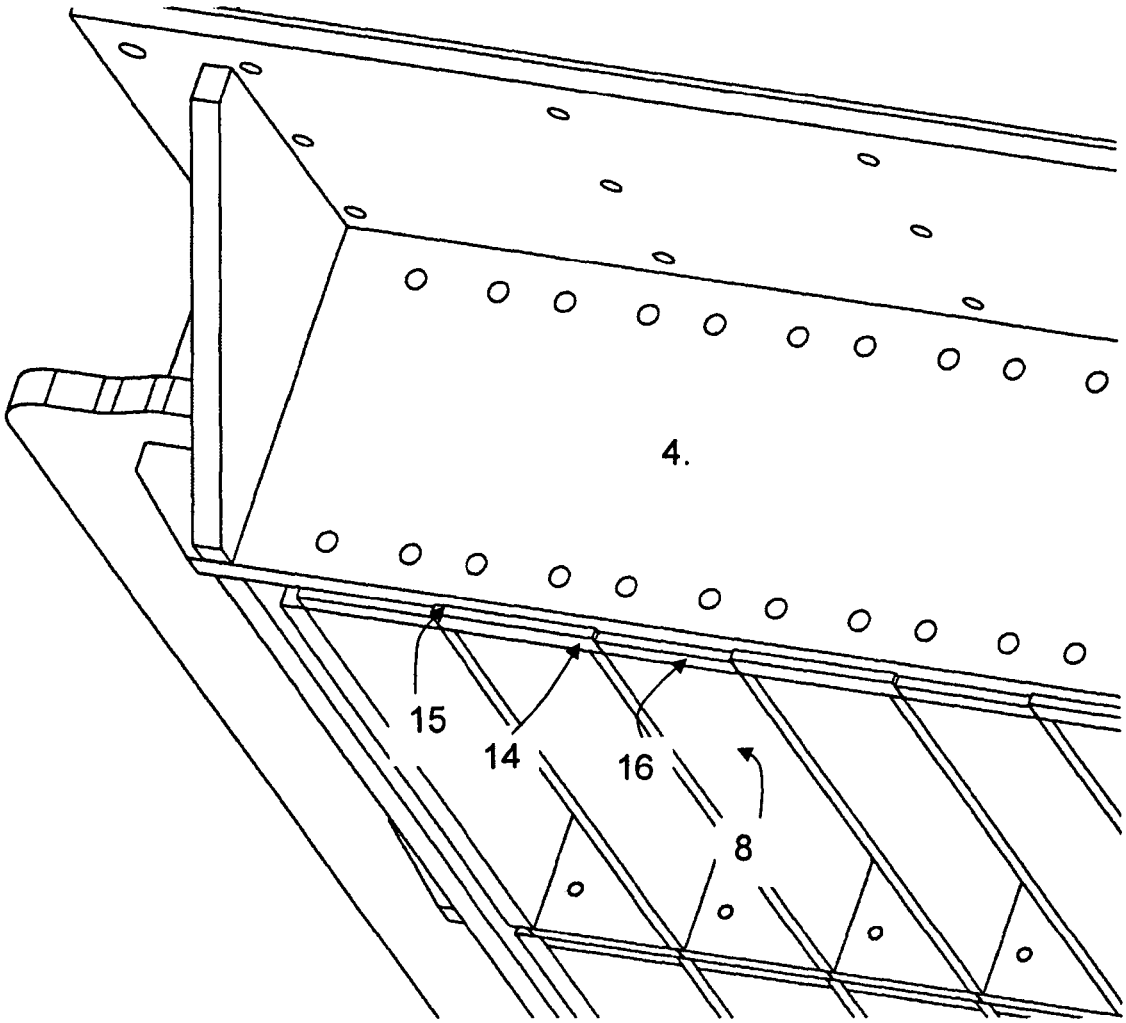
FIG. 6 shows how the boss on the end plate with lower pins bears on the underside of the mould frame.

FIG. 6 shows how the collar (15) on the end plate with lower pins (14) bear against the underside of the mould frame (4), thus ensuring that the insert parts cannot move upwards during the strong compressing vibration applied to mould and products from below.

Figure 7:
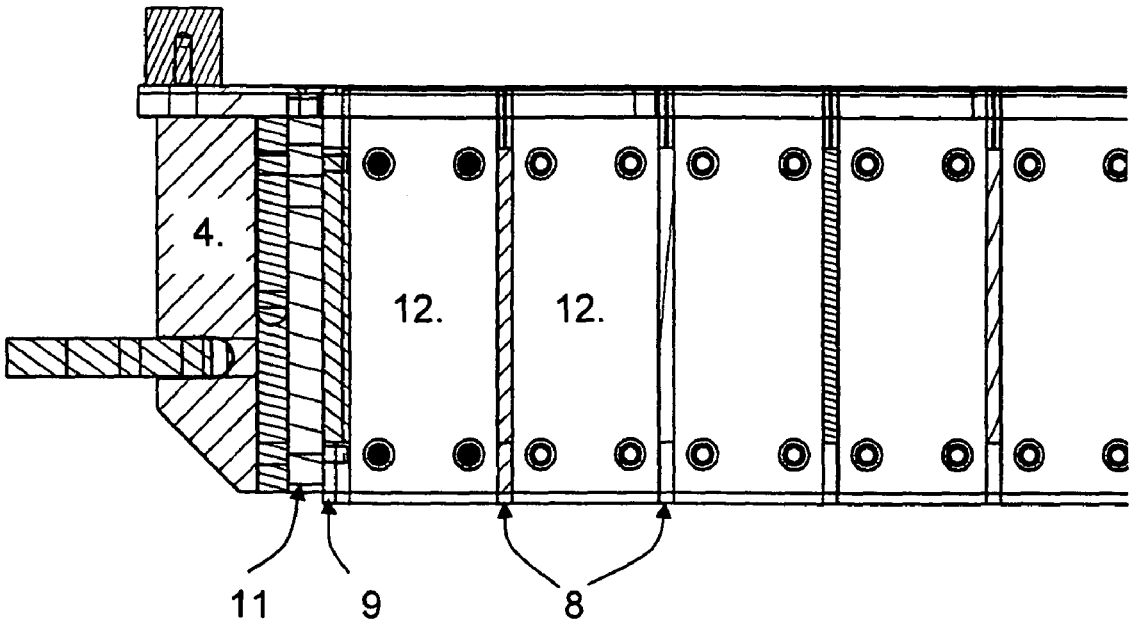
FIG. 7 is a sectional view of a casting equipment, where the intermediate layer for filling the remaining space in the side is shown.

FIG. 7 shows the intermediate layer (11) disposed between the mould frame (4) and gable (9) in order to fill the remaining cavity appearing in the mould frame after mounting and compressing all the insert parts. The intermediate layer may possibly consist of more standard thickless plates which may then be combined to the thickness of the remaining space. It may e.g. be plates of 10 mm, 5 mm, 2 mm, or 1 mm thickness.

Figure 8:
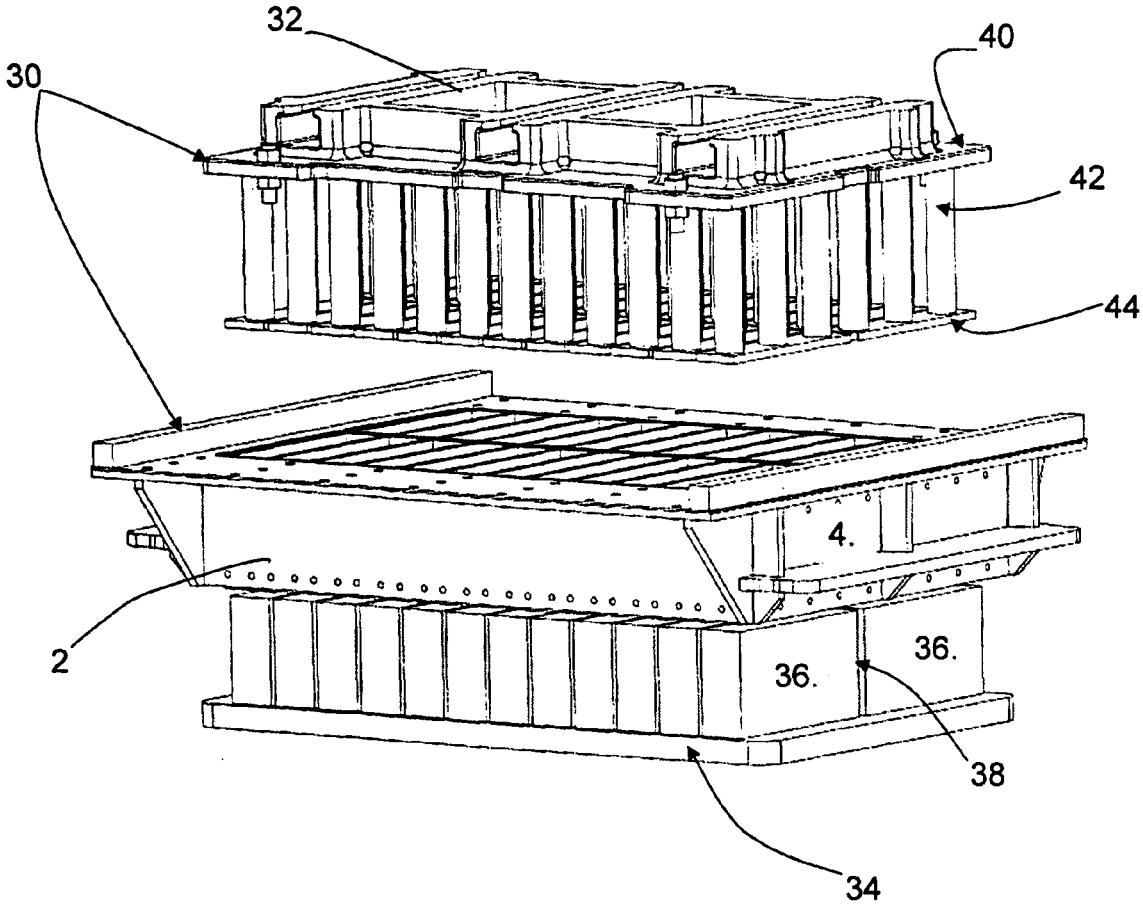
FIG. 8 is a perspective view of a complete casting equipment with replaceable wear parts according to the invention, shown in a stripping sequence where the spacing between the two rows of block moulds are indicated.

FIG. 8 shows a complete mould (30) with a mould upper part (32) consisting of a top plate (40) with downwards projecting press pistons (42) mounted with pressing plates (44) with a shape as the cell situated below. The mould upper part (32) may thus act as multiple pressing piston during compression and as retainer during stripping when the lower mould part (2) is lifted off the newly cast products (36). The shown mould is for producing solid concrete blocks. On the production plate (34) stand the two rows of concrete products (36) which are made by this mould with a small mutual spacing (38) between the two rows of products.

With a small distance (38), the production plate (34) can be utilised optimally. In this way, the production plate (34) can be made either shorter, if the product is not wanted long, due to e.g. a standard for the block, thereby reducing the hardening area or allowing more production plates (34) in the hardening area, or if the product (36) is not included in any product standard, elongate the product (36) corresponding to the saved space, thus utilising the production plate (34) better.

LIST OF POSITION NUMBERS

2. Lower mould part with replaceable insert parts
4. Mould frame
6. Cells
8. Partitioning
9. Gable
10. End wall
11. Intermediate layer
12. Intermediate wall
14. End wall with lower pins and collar
15. Collar on end wall with lower pins
16. End wall with upper pins
18. Intermediate wall with lower pins
20. Intermediate wall with upper pins
22. End wall with lower pins with recess for support irons for cores
23. End wall with upper pins with recess for support irons for cores
24. Intermediate wall with lower pins with recess for securing support irons for cores
25. Recess in intermediate wall for securing support iron for cores
26. Intermediate wall with lower pins with recess for securing support irons for cores
27. Recess for support iron for cores
28. Support iron for cores
29. Boss on support iron fitting in recess in intermediate walls
30. Casting equipment
32. Upper mould part with lower press pistons
34. Productions plate
36. Blocks
38. Spacing between block rows
40. Top holding plate
42. Pressing pistons
44. Thrust plates

The invention claimed is:

1. Apparatus comprising a mould lower part for use in a casting equipment, wherein the mould lower part includes a frame having opposite side walls, gable walls (9), welded together and reinforced and replaceable surfaces in the frame, the replaceable surfaces further comprising replaceable partitions extending across the frame parallel to the gable walls, replaceable gable plates, replaceable end plates, and replaceable intermediate walls, where one or more of the intermediate walls (12) together with the partitions (8) are made as a self-supporting construction, each intermediate wall (12) further comprising two wall parts (18, 20), of which a first wall part (18) is provided with lower pins and a second wall part (20) is provided with upper pins, where said pins engage and interlock openings in adjacent partitions (8) when said intermediate wall parts are assembled and, the pins are releasably connected to openings in an adjacent gable plate (9) and wherein the intermediate wall parts are connected by releasable joining fasteners.

2. The apparatus lower part according to claim 1, wherein the mould lower part is designed for making products with hollows, whereby each of the intermediate walls and (12) are provided with recesses (25) in the intermediate wall parts (24, 26) for securing core support irons (28).

3. Mould lower part according to claim 1, wherein the partitions, intermediate walls, gable plates and end plates are one or more replaceable wear parts, wherein the partitions and the gable plates have intermediate and end lower and upper openings, wherein the pins on the intermediate wall parts extend halfway into the intermediate lower and upper openings, and the fasteners are removable fasteners, and one or more of the intermediate walls (12, 18, 20, 24, 26) are replaceable immediately by loosening the removable fasteners and separating the two wall parts.

4. Apparatus comprising casting equipment for concrete casting machines used for production of cast items without or with cavities for wall construction, further comprising a cellular lower mould part with exchangeable insert parts with upwards and downwards open cells (6), which define the desired basic form of the individual, and a corresponding upper part (32) further comprising an upper retainer plate (40), pressing pistons (42) projecting downwards from the upper retainer plate, the pressing pistons having lower thrust plates (44) which fit in the respective underlying cells (6) in the lower mould part and thereby are useful for downwards ejection of the cast items from the cells (6), wherein in the lower part one or more intermediate walls (12) together with one or more partitionings (8) are self-supporting, each intermediate wall (12) further comprising of two wall parts (18, 20), of which one wall part (18) has lower pins and one wall part (20) has upper pins wherein the lower and upper pins fit in lower and upper openings in adjacent partitionings (8) and, in outermost cells, the lower and upper pins are releasably connected to upper and lower openings in an adjacent gable plate (9) and wherein the wall parts 18, 20 of each of the intermediate walls are connected by a releasable joining fasteners.

5. Apparatus according to claim 4, wherein the casting equipment is for making products with hollows, whereby the one or more intermediate walls (12) and the intermediate wall parts have upward opening recesses (25) and further comprising core support irons (28) having support pins (29) on the support irons (28), and wherein the support pins are received in the recesses.

6. Casting equipment according to claim 4, wherein single or more wear parts, including the partitionings (8), gables plates (9), a plurality of end walls (10, 14), one or more of the intermediate walls (12) are wear parts replaceable by loosening the fasteners.

7. A casting mould apparatus comprising a mould lower part, having a frame, the frame having side walls, gable walls and reinforcements, further comprising replaceable elements for mounting within the frame, the replaceable elements comprising plural intermediate walls and plural partitions having end upper and lower openings and intermediate upper and lower openings, and plural end walls forming walls of cells in the mould lower part, one or more of the plural intermediate walls together with one or more of the plural partitions forming a self-supporting structure, the plural end walls secured to the frame with removable fasteners, the plural end walls alternately comprising lower pins or upper pins for connecting to the end lower and upper openings in the partitions by alternately connecting the end walls between the partitions, wherein each of the plural intermediate walls having of two complementary wall halves, one wall half further comprising lower pins and another wall half further comprising upper pins, wherein the lower pins and the upper pins engaging the intermediate lower and upper openings in adjacent partitions of the plural partitions, and removable fasteners connecting the wall halves, and gable plates forming one or more outermost cells with outermost upper and lower pins of the intermediate wall halves connected in upper and lower openings in the gable plates.

8. The apparatus of claim 7, further comprising upper recesses in the intermediate wall parts and plural core support irons each including support pins for securing and supporting the plural core support irons in the recesses in the intermediate wall parts.

9. The apparatus of claim 7, wherein each of the plural partitions, the plural gable plates, the plural end walls and the plural intermediate walls is removable and replaceable individually by loosening any of the plural releasable fasteners.

10. Casting equipment for concrete casting machines for production of cast concrete blocks with or without cavities or recesses comprising a lower part having a frame with side walls, gable walls and reinforcements and with plural exchangeable insert parts with upwards and downwards opening plural cells forming basic forms of individual blocks, a corresponding upper part with an upper retainer plate comprising plural pressing pistons projecting downwards, the plural pressing pistons comprising lower thrust plates adapted for fitting in respective underlying cells of the plural cells in the lower part and thereby allowing for downwards ejection of the cast blocks from the plural cells, the plural exchangeable insert parts further comprising one or more intermediate walls and one or more partitions forming the lower part, one or more of the intermediate walls together with one or more of the partitions forming a self-supporting structure, the one or more partitions having upper and lower end and intermediate openings and each of the one or more intermediate walls having two complementary wall halves, one wall half comprising one or more lower pins and another wall half comprising one or more upper pins, adjacent lower and upper pins of the one or more lower pins and the one or more upper pins being adapted for engaging the lower and upper intermediate openings in the one or more partitions and interlocking around adjacent partitions of the one or more partitions when said complementary wall halves are assembled, one or more gable plates having lower and upper intermediate and end openings and forming one or more outermost cells with outermost upper and lower pins of the one or more intermediate walls engaging the intermediate openings of the one or more gable plates, and plural end walls alternately having lower pins or upper pins and the end walls being alternately arranged and connected with the partitions with the pins of the end walls in the end openings of the partitions, the intermediate wall halves being connected with each other and the gable plates being connected to the gable walls and the end walls being connected to the side walls of the frame with releasable fasteners.

11. Apparatus comprising a mould having a frame with opposite side walls and gable walls at ends of the side walls replaceable walls forming cells within the frame, the replaceable walls further comprising partitions extending between the side walls parallel to the gable walls, gable plates along the gable walls, wherein the partitions and the gable plates having intermediate upper and lower openings and end upper and lower openings, intermediate walls extending between adjacent ones of the partitions and the gable plates each of the intermediate walls having a first intermediate wall part with lower pins fitting in the intermediate lower openings and a second intermediate wall part with upper pins fitting in the intermediate upper openings and having fasteners connecting the first and second intermediate wall parts with each other, and first and second end plates alternately extending between ends of the partitions, the first end plates having lower pins extending into the end lower openings and the second end plates having upper pins extending into the end upper openings and fasteners connecting the first and second end plates to the side walls of the frame.

12. The apparatus of claim 11, further comprising upper recesses in the intermediate walls and in the end plates and core irons extending between the side walls and supported in the upper recesses in the intermediate walls and in the end plates.

13. The apparatus of claim 11, further comprising collars extending from lower ends of the first end plates beneath the side walls.

14. The apparatus of claim 11, wherein the upper and lower pins of the intermediate wall parts extend halfway into the intermediate upper and lower openings in the partitions.

15. The new apparatus of claim 11, wherein the lower and upper pins of the end plates extend substantially fully into the lower and upper end openings in the partitions.

16. The apparatus of claim 11, wherein the partitions, the intermediate walls, the end plates and the gable plates are removable wear elements.

* * * * *